US009143852B2

(12) United States Patent
Demier

(10) Patent No.: US 9,143,852 B2
(45) Date of Patent: Sep. 22, 2015

(54) STATELESS CORD MANAGEMENT DEVICE

(71) Applicant: Cal T Demier, Key West, FL (US)

(72) Inventor: Cal T Demier, Key West, FL (US)

( * ) Notice: Subject to any disclaimer, the term of this patent is extended or adjusted under 35 U.S.C. 154(b) by 110 days.

(21) Appl. No.: 14/022,394

(22) Filed: Sep. 10, 2013

(65) Prior Publication Data

US 2015/0067988 A1 Mar. 12, 2015

(51) Int. Cl.
*H04R 1/10* (2006.01)

(52) U.S. Cl.
CPC ..... *H04R 1/1033* (2013.01); *Y10T 24/39* (2015.01); *Y10T 24/3907* (2015.01)

(58) Field of Classification Search
CPC ... H04R 1/1033; Y10T 24/3907; Y10T 24/39
See application file for complete search history.

(56) References Cited

U.S. PATENT DOCUMENTS

| | | | | |
|---|---|---|---|---|
| 1,435,311 | A | 11/1922 | Knight | |
| 1,708,470 | A * | 4/1929 | Eckert et al. | 403/391 |
| 3,636,595 | A | 1/1972 | Wines | |
| 4,285,486 | A | 8/1981 | Von Osten et al. | |
| 4,406,042 | A | 9/1983 | McPhee | |
| 5,130,496 | A | 7/1992 | Jenkins | |
| 5,600,098 | A | 2/1997 | Kazaks | |
| D408,365 | S | 4/1999 | Sanders | |
| 5,895,288 | A | 4/1999 | Nelson | |
| D421,715 | S | 3/2000 | Won | |
| D445,093 | S | 7/2001 | Staskey | |
| 6,425,165 | B2 | 7/2002 | Koppang | |
| 6,425,543 | B1 | 7/2002 | King | |
| D464,875 | S | 10/2002 | Koppang | |
| 7,355,119 | B2 | 4/2008 | Katz et al. | |
| D584,132 | S | 1/2009 | Judd | |
| 7,610,661 | B2 | 11/2009 | Sween et al. | |
| 7,712,696 | B2 * | 5/2010 | Loh | 242/360 |
| 7,882,600 | B2 | 2/2011 | Judd | |
| 8,635,750 | B1 * | 1/2014 | Ginocchio | 24/484 |
| 2008/0289151 | A1 * | 11/2008 | Chan | 24/3.1 |
| 2009/0013504 | A1 * | 1/2009 | Crespo | 24/306 |
| 2009/0211063 | A1 * | 8/2009 | Ginocchio | 24/270 |
| 2011/0252606 | A1 * | 10/2011 | Rothbaum et al. | 24/302 |
| 2011/0252607 | A1 * | 10/2011 | Rothbaum et al. | 24/303 |
| 2011/0252608 | A1 * | 10/2011 | Rothbaum et al. | 24/306 |
| 2011/0252609 | A1 * | 10/2011 | Rothbaum et al. | 24/306 |
| 2011/0308049 | A1 * | 12/2011 | Sun | 24/306 |
| 2012/0265714 | A1 * | 10/2012 | Duval | 705/500 |
| 2012/0288132 | A1 * | 11/2012 | Massey | 381/381 |

FOREIGN PATENT DOCUMENTS

WO WO 2011149361 A2 * 12/2011

* cited by examiner

*Primary Examiner* — Victor Batson
*Assistant Examiner* — Louis Mercado
(74) *Attorney, Agent, or Firm* — Malloy & Malloy, P.L.

(57) ABSTRACT

A stateless cord management device for storage and deployment of a cord, cable, or wire comprises a body having a sidewall with oppositely disposed open ends. A channel is at least partially defined by the sidewall and disposed therethrough between the oppositely disposed open ends. An access opening extends longitudinally along and through the sidewall between the oppositely disposed open ends of the sidewall. The access opening is at least partially defined by cooperatively disposed and abutting free ends of the sidewall, the free ends being at least partially separable from one another permitting access into the channel.

9 Claims, 3 Drawing Sheets

STATELESS CORD MANAGEMENT DEVICE

BACKGROUND OF THE INVENTION

1. Field of the Invention

The present invention is directed to a device for the management of a variety of cables, cords, and/or wires, wherein the device remains in substantially the same physical state whether storing or deploying a cord, or as releasably attached to the same during use.

2. Description of the Related Art

Headphones, cables, and power cords are common in today's portable environment for a wide range of mobile devices including music players, laptops, tablet computers, smart phones, wearable electronics, etc. The storage and transport of the cords and wires by a user prove to be problematic, particularly when multiple cords are stored together and become entangled with one another.

Current cable or cord management devices are difficult to use and generally require a user to keep track of an additional component, such as a headphone case or cord winder. Headphone cases require a user to bunch up the cables in order to mold and conform to a case, however, the case does not prevent snags or tangles of the cable. Cord winders allow a user to wind a cord while avoiding tangles, but they generally offer no easy way of removing the bulk of the cord for operation, nor do they remain attached to the cord when it is in use. Thus, cord winders are easily misplaced, left behind, or even lost, and are therefore often unavailable when needed after use of a device.

As such, there is a need for an improved cord management device, while overcoming disadvantages and problems of the type set forth above. Moreover, an improved and proposed cord management device can incorporate a variety of unique structural and operative features which may be pleasing to the consuming public and which can be produced at a reasonable cost. Such an improved cord management device may facilitate the ease of winding or unwinding of the cord to a desired length during use, as well as the bulk removal of the cord from the device, and has the ability to remain attached to at least a portion of a cable or cord during use in an unobtrusive manner. In addition, such an improved cord management device can include printed or otherwise formed indicia disposed thereon in an observable location, and serving as an added decorative feature and/or as an advertising and marketing tool.

SUMMARY OF THE INVENTION

The present invention is directed to a stateless cord management device. The device allows attachment to at least a portion of a cord, facilitates the ease of winding or unwinding the cord to a desired length during use, as well as the bulk removal of the cord from the device.

A stateless cord management device may be of a singular, integral construction in at least one embodiment. Unlike known cord management devices, the present stateless cord management device does not require the fabrication of multiple, discrete components, nor does it require assembly of such components in an assembly process.

More in particular, in at least one embodiment, a stateless cord management device in accordance with the present invention generally comprises a body having a sidewall with oppositely disposed open ends, the sidewall defining a channel therethrough. The sidewall further comprises abutting free ends which are cooperatively structured to at least partially define an access opening into the channel.

The body may comprise any of a number of geometric configurations including, but in no manner limited to, triangular, tetragonal, cylindrical, etc. In other embodiments, the body may comprise a spherical, cubic, or tubular configuration.

In at least one embodiment, the channel is at least partially defined by the sidewall and is disposed therethrough between the oppositely disposed open ends. The channel is dimensioned to retain at least a portion of the cord therein.

An access opening extends longitudinally along and through the sidewall, and in at least one embodiment, is disposed between the oppositely disposed open ends. In one further embodiment, the access opening is at least partially defined by cooperatively structured abutting free ends to permit access into the channel. The cooperatively structured abutting free ends are structured of a resilient material, in at least once embodiment, such that the access opening is normally biased into a closed configuration in order to retain a portion of the cord within the channel. Further, when winding or unwinding the cord, the abutting free ends of the access opening separate from one enough a sufficient distance to allow the cord to enter or exit the channel through the access opening, when external force is applied by the cord. In at least one further embodiment, the sidewall is sufficiently flexible to allow for the bulk removal or the removal of a cord from the channel through the access opening.

At least one embodiment of the present invention comprises a retention assembly to facilitate receipt and retention of at least one end of a cord therein. The retention assembly comprises at least one retaining slit through at least a portion of the sidewall. The retention assembly allows the stateless cord management device to be releasably attached to a portion of a cord, and to retain the cord management device to a portion of the cord, regardless of whether the cord is stored or deployed, thereby alleviating the need to keep track of an additional and separate storage component.

The sidewall comprises at least one notch proximate one of the open ends in aligned relation to the access opening, in at least one embodiment of the present invention. The notch facilitates receipt of a portion of a cord and passage of at least the portion of the cord through the access opening into the channel. In at least one embodiment, the sidewall comprises a first notch proximate a first open end, and a second notch is proximate a second open end, both the first notch and the second notch disposed in an aligned relation with the access opening. The notch or notches in this embodiment facilitate receipt of a cord during a winding operation for storage or to adjust its length during use.

At least one display area is formed on the body in at least one embodiment of the present invention. The display area may comprise design indicia such as, but not limited to, logos, graphics, text, symbols and characters, or any combinations thereof. The display area may be formed on the interior or exterior of the body. A plurality of display areas may be formed along the body, in at least one embodiment.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION

As stated above, the present invention is directed to a stateless cord management device for storage and deployment of a cord, generally shown as 100 in the accompanying figures.

Figure 1:
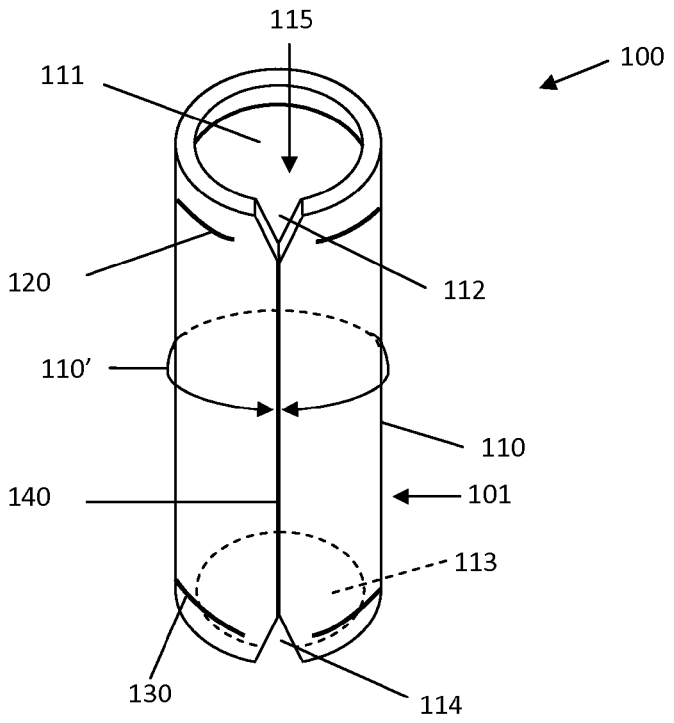
FIG. 1 is a front perspective view of one illustrative embodiment of a stateless cord management device in accordance with the present invention.

FIGS. 1 presents a front perspective view of one illustrative embodiment of a stateless cord management device 100 for storage and deployment of a cord in accordance with the present invention. As shown in FIG. 1, the stateless cord management device 100 comprises a body 101 having a sidewall 110 with oppositely disposed open ends, namely, first open end 111 and second open end 113.

In the embodiments shown in the accompanying figures, the sidewall 110 comprises a substantially cylindrical configuration at least partially defined by a circumference 110'. Of course, it is within the scope and intent of the present invention for the sidewall 110 to comprise any of a number of other geometric configurations including, but in no manner limited to, polygonal, spherical, cubic, tubular, oval, elliptical, etc.

Figure 3:
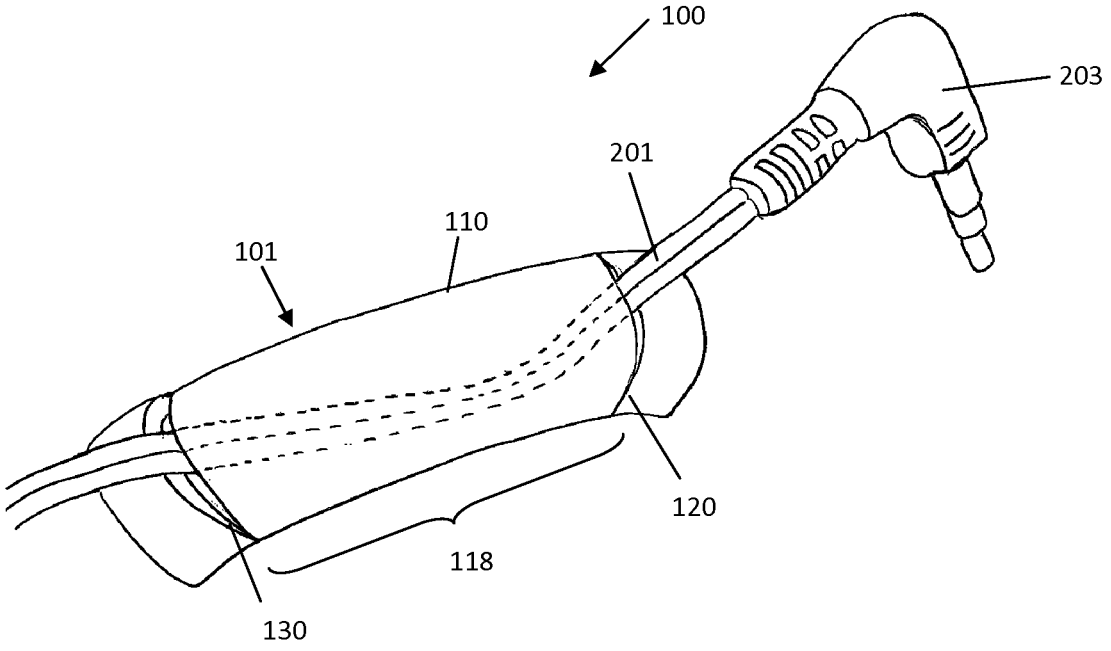
FIG. 3 is a perspective view of the illustrative embodiment of FIG. 1 having one end of a cord releasably retained by a retention assembly.

As shown in FIG. 1, in at least one embodiment, a channel 115 is at least partially defined by the sidewall 110 and is disposed therethrough between the oppositely disposed open ends 111 and 113. The channel 115 is dimensioned to retain at least a portion of a cord 201 therein, as illustrated in the embodiment of FIG. 3.

Figure 2:
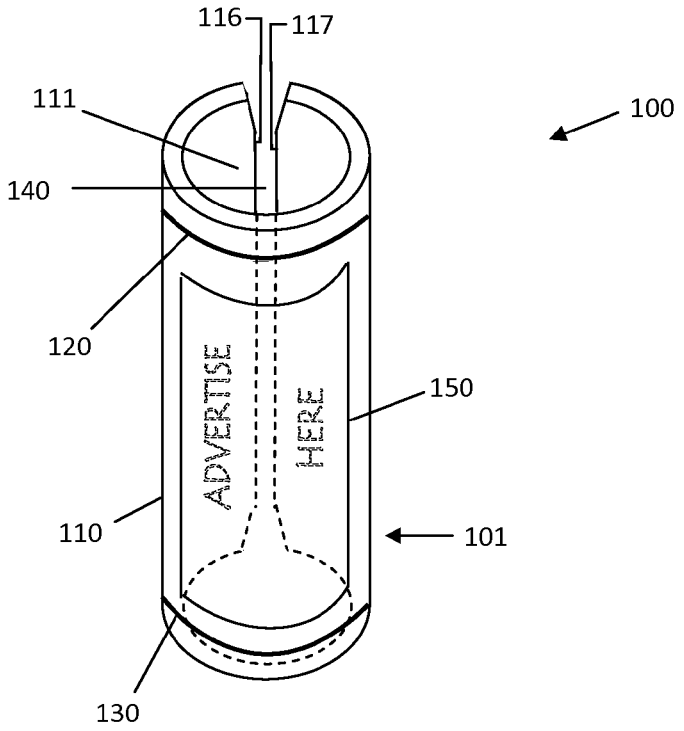
FIG. 2 is a rear perspective view of the illustrative embodiment of FIG. 1.

As illustrated best in FIG. 1, an access opening 140 is disposed between the oppositely disposed first open end 111 and second open end 113, and extends longitudinally along and through the body 101. The access opening 140 is at least partially defined by cooperatively structured abutting free ends 116 and 117 of the sidewall 110, as shown in FIG. 2. As further illustrated in FIG. 2, the abutting free ends 116 and 117 are at least partially separable from one another to permit access into the channel 115 by a cord.

Figure 4:
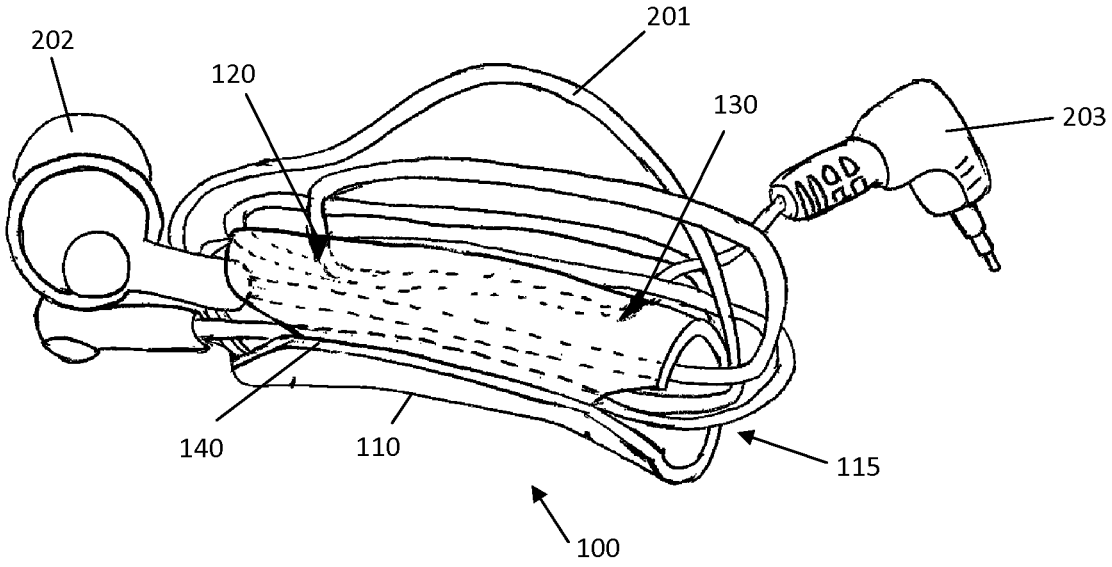
FIG. 4 is a perspective view of the illustrative embodiment of FIG. 1 having a portion of a cord retained within a channel.

In at least one embodiment, the access opening 140 will retain a normally closed configuration as shown best in FIGS. 1 and 4. Accordingly, separation of the abutting free ends 116 and 117 will occurs only upon an exertion of external force, in at least one embodiment, such as when a cord is wound or unwound through the access opening 140.

In at least one embodiment, the sidewall 110 is formed from a flexible material to permit the abutting free ends 116 and 117 to be easily separable from one another to permit access into the channel 115 by a portion of the cord 201. In at least one further embodiment the sidewall 110 comprises a material of construction which is sufficiently resilient to bias the access opening 140 into a normally closed configuration, such as is shown in FIGS. 1 and 4, in order to retain storage at least a portion of a cord 201 within the retention channel 115, such as is shown in FIG. 4.

As shown in FIG. 3, the sidewall 110 comprises a retention assembly 118 in at least one embodiment of the present invention. The retention assembly 118 facilitates receipt and retention of at least a portion of a cord 201 therein. The retention assembly 118, in at least one embodiment, comprises at least one retaining slit 120 through at least a portion of the sidewall 110. In the embodiment of FIG. 3, a headphone connector 203 and a portion of a cord 201 is passed through a pair of retaining slits 120 and 130, thereby retaining a portion of the cord 201 therein. The retaining slits 120 and 130 may be disposed proximate the open ends 112 and 113, as shown in the embodiment of FIG. 3, however, it is understood to be within the scope of the present invention for other embodiments to comprise one or more retaining slit 120, 130 through other portions of a sidewall 110.

Furthermore, the retaining slits 120, 130 may be disposed longitudinally, latitudinally, diagonally, etc., relative to the sidewall 110. In yet another embodiment, the retaining slits 120, 130 comprise an overlying configuration, for example, a cross or an "X" configuration.

At least one notch is formed in a sidewall 110 of the body 101 of a stateless cord management device 100 in accordance with at least one embodiment of the present invention. Looking again to the illustrative embodiment of FIG. 1, a first notch 112 is formed proximate first open end 111, and the first notch 112 is disposed in an aligned relation to access opening 140. The first notch 112 facilitates receipt of a portion of a cord 201 and passage of at least the portion of the cord through the access opening 140 into the channel 115. In addition, the illustrative embodiment of FIG. 1 comprises a second notch 114 proximate the second open end 113, and also in aligned relation with the access opening 140. The first notch 112 and the second notch 114 cooperatively facilitate receipt of a portion of a cord at each of the first notch 112 and the second notch 114, and passage of at least a portion of the cord through the access opening 140 into the channel 115. This increases the ease of winding a cord 201 onto a stateless cord management device 110 for storage, as shown in FIG. 5, or to adjust its length during use.

At least one display area 150 may be formed on the body 101 of a stateless cord management device 100 in accordance with the present invention. A display area 150 comprises design indicia such as but not limited to logos, graphics, text, symbols and characters, or any combinations thereof. The display area 150 is visible along at least a portion of the body 101, in some embodiments, and in other embodiments, the display area 150 comprise substantially the entire surface of the body 101. A plurality of display areas 150 may also be employed, each display area 150 being visible along a different corresponding portion of the body 101. In at least one embodiment, such as is shown in FIG. 2, the display area 150 serves advertising or marketing purposes. In at least one further embodiment, custom design indicia is incorporated onto the display area 150.

Figure 5:
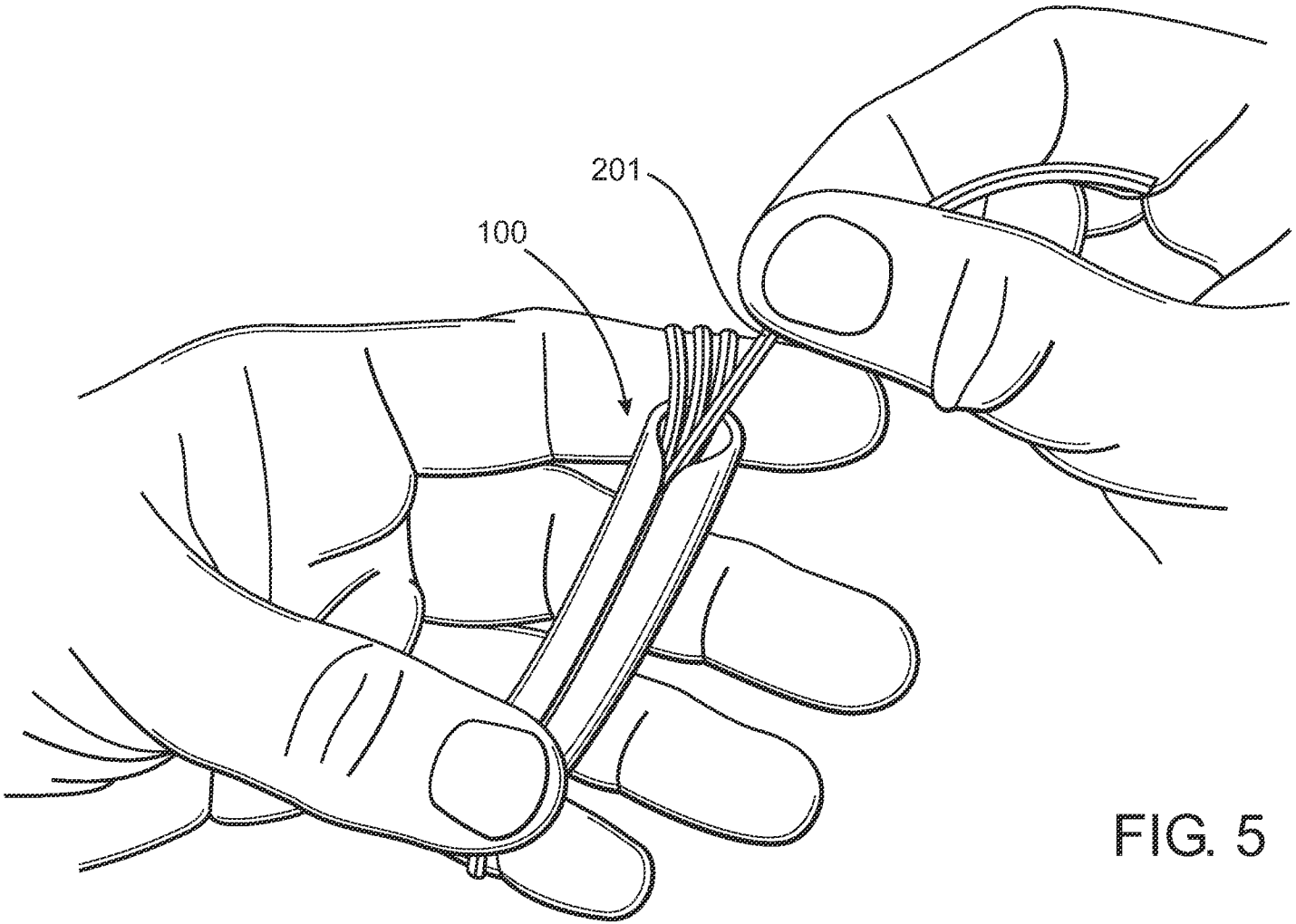
FIG. 5 is a perspective view illustrating the use of one embodiment of a stateless cord management device in accordance with the present invention.

Operation of one embodiment of a stateless cord management device 100 in accordance with the present invention is illustrated in FIGS. 3 through 5. In FIG. 3, one end of a pair of headphones, such as a headphone connector 203, is inserted through retaining slits 130 and 120. The retaining slits 130, 120 in this embodiment are disposed along and through at least a portion of the sidewall 110 along a circumference 110' thereof. In at least one embodiment, the retaining slits 120, 130 are disposed through a majority of the sidewall 110 to allow the sidewall 110 to be easily bent to facilitate opening and insertion of cord, wire, or cable, such as a headphone connector 203 and at least a portion of a cord 201, through retaining slits 120, 130. The remainder of the cord 201 may then be wound into the channel 115 for storage, such as is shown in FIG. 4. The cord 201 may be selectively wound to shorten the cord 201 length, or unwound to extend the cord 201 length available during use. This, for instance, allows a user to adjust a cord 201 to the desired length during use. For storage, portions of the cord 201 are wound through the access opening 140 into the channel 115. As shown in the embodiment of FIG. 4, when the cord 201 is wound into channel 115, the ear buds 202 becomes proximately disposed to the body 101 of the cordless management device 100. As will be appreciated, the present stateless cord management device facilitates storage and transit of a pair of portable headphones with ease, while reducing the possibility of tangling of the cord 201.

In at least one embodiment, a stateless cord management device 100 in accordance with the present invention comprises a unitary construction. Further, a body 101 in accordance with at least one embodiment of the present invention is at least partially formed of a flexible material to allow access into the channel 115 through the access opening 140, upon the application of external force when a cord 201 is being wound onto or unwound form the channel 115. A flexible or resilient material of construction of the body 101 and/or sidewall 110 retains the access opening 140 in a closed configuration when no external force is applied, as illustrated in FIG. 1. The body 101 of the present invention may further be formed of a light weight material to facilitate wear ability.

In at least one embodiment, a stateless cord management device 100 in accordance with the present invention comprises a vinyl tubing material of construction. The vinyl tubing, in at least one embodiment, comprises an outside diameter of about one-half inch and an inside diameter of about three-eighths inch for the retention of portable headphone cables. Alternate embodiments may comprise other flexible and/or resilient materials such as latex, rubber, plastic, etc. Further, the outside and inside diameters of any of the appropriate materials may comprise other dimensions for other embodiments, such as the retention of phone cords, power adapters, communication cables such as USB, Ethernet, HDMI, as well as other cords and wires of various sizes and lengths.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A stateless cord management device for storage and deployment of a cord, said device comprising:

a body comprising a sidewall having a first open end and a second open end, said first open end and said second open end being oppositely disposed from one another, a channel at least partially defined by said sidewall and disposed therethrough between said first open end and second open end, an access opening extending longitudinally along and through said sidewall between said first open end and said second open end, said access opening is at least partially defined by cooperatively disposed and abutting free ends of the sidewall, said free ends being at least partially separable from one another permitting access into said channel, said sidewall comprises a first notch proximate said first open end and in an aligned relation with a portion of said access opening, said sidewall further comprises a second notch proximate said second open end in aligned relation with said access opening, and a retention assembly to facilitate receipt and retention of at least one end of the cord therein.

2. The device as recited in claim 1 wherein each of said first notch and said second notch facilitate receipt of a portion of the cord therein and passage of at least the portion of the cord through said access opening and into said channel.

3. The device as recited in claim 1 wherein said retention assembly comprises a first retaining slit through at least a portion of said sidewall.

4. The device as recited in claim 3 wherein said retention assembly further comprises a second retaining slit through at least a different portion of said sidewall.

5. The device as recited in claim 1 wherein said body is at least partially formed of a flexible material.

6. The device as recited in claim 1 wherein said body further comprises at least one display area.

7. A stateless cord management device for storage and deployment of a cord, said device comprising:

a body comprising a sidewall having a first open end and a second open end, said first open end and said second open end being oppositely disposed from one another, a channel at least partially defined by said sidewall and disposed therethrough between said first open end and second open end, an access opening extending longitudinally along and through said sidewall between said first open end and said second open end, said access opening is at least partially defined by cooperatively disposed and abutting free ends of the sidewall, said free ends being at least partially separable from one another permitting access into said channel, and a retention assembly to facilitate receipt and retention of at least one end of the cord therein, wherein said retention assembly comprises a first retaining slit through at least a portion of said sidewall and a second retaining slit through at least a different portion of said sidewall.

8. The device as recited in claim 7 wherein said body is at least partially formed of a flexible material.

9. The device as recited in claim 7 wherein said body further comprises at least one display area.

* * * * *